US006691902B2

(12) United States Patent
Gomez

(10) Patent No.: US 6,691,902 B2
(45) Date of Patent: Feb. 17, 2004

(54) BOTTLE FILLING DEVICE

(76) Inventor: Sherri Gomez, 2424 Andover Pl., Costa Mesa, CA (US) 92626

( * ) Notice: Subject to any disclaimer, the term of this patent is extended or adjusted under 35 U.S.C. 154(b) by 0 days.

(21) Appl. No.: 10/120,879

(22) Filed: Apr. 11, 2002

(65) Prior Publication Data

US 2003/0192622 A1 Oct. 16, 2003

(51) Int. Cl.[7] ..... B65B 3/04

(52) U.S. Cl. ..... 222/566; 222/525; 141/392; 141/DIG. 1; 251/155; 285/8

(58) Field of Search ..... 222/525, 527–530, 222/538, 559–563, 566, 571; 141/332, 337, 392, DIG. 1; 251/155; 185/8

(56) References Cited

U.S. PATENT DOCUMENTS

| | | | | | |
|---|---|---|---|---|---|
| 560,070 | A | | 5/1896 | Staub et al. | |
| 926,550 | A | * | 6/1909 | Dafoe | 141/387 |
| 946,039 | A | | 1/1910 | Hausdorf | |
| 1,071,165 | A | * | 8/1913 | Manning | 417/181 |
| 1,434,945 | A | | 11/1922 | Cooper | 137/603 |
| 1,628,733 | A | * | 5/1927 | Morris | 137/625.11 |
| 1,893,498 | A | | 1/1933 | Herzog | 134/167 R |
| 2,002,592 | A | | 5/1935 | Stremel | 141/44 |
| 2,054,265 | A | | 9/1936 | Ditchian | 141/332 |
| 2,641,270 | A | | 6/1953 | Allen | 134/200 |
| 4,098,398 | A | | 7/1978 | Meyers | 206/223 |
| 4,703,785 | A | | 11/1987 | Antos et al. | 141/326 |
| 4,784,184 | A | | 11/1988 | Gates | 138/109 |
| D304,294 | S | | 10/1989 | Grenda | D9/337 |
| 4,921,147 | A | | 5/1990 | Poirier | 222/527 |
| 5,667,146 | A | | 9/1997 | Pimentel et al. | 239/587.1 |

* cited by examiner

*Primary Examiner*—J. Casimer Jacyna
(74) *Attorney, Agent, or Firm*—Dennis W. Beech

(57) ABSTRACT

The bottle filling device may be used to aid in the filling of a small fluid bottle container from an external liquid source. An inlet fitting that is expansible allowing a friction fit on a variety of spouts of varying sizes may be fitted to a spout. An outlet end of the bottle filling device has a funnel spout with an opening sized for dispensing fluids within the diameter of a mouth of a small water bottle. It is emphasized that this abstract is provided to comply with the rules requiring an abstract that will allow a search or other reader to quickly ascertain the subject matter of the technical disclosure. It is submitted with the understanding that it will not be used to interpret or limit the scope or meaning of the claims.

2 Claims, 1 Drawing Sheet

BOTTLE FILLING DEVICE

BACKGROUND OF THE INVENTION

This invention relates to devices that aid the filling of fluid containers. The improved device includes a structure to accommodate a variety of spout shapes for liquid dispensing sources and an outlet end to aid in channeling the fluid into a fluid container.

There are existing devices for aiding in the channeling of fluid from a fluid reservoir to a fluid container. These devices generally attach to a fluid reservoir spout and extend therefrom in the form of a flexible conduit that may have an outlet opening designed to fit into the mouth of a fluid container. A common example of a flexible, extending device is the common garden hose.

In the field of water reservoir and dispensing devices, such as, for bottled water that may be used in the home and office, the water reservoir device normally has a fixed spout. The shape and size of water spouts varies from manufacturer to manufacturer. Should a user wish to fill a small bottle fluid container, the mouth of the container may not be large enough to accept the opening of the spout. In such situations there may be spillage of water as the fluid container is filled. As can be seen, there is a need for an adapter device for attachment to reservoir spout apparatus to accommodate the filling of small bottle fluid containers.

SUMMARY OF THE INVENTION

The present invention is directed to devices for aiding in the filling of a small fluid bottle container from an external liquid source. An inlet fitting that is elastic and sized to be expansible allowing a friction fit on a variety of spouts of varying sizes may be fitted to a spout. An outlet end of the bottle filling device has a funnel for dispensing fluids within the diameter of a mouth of a small water bottle.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
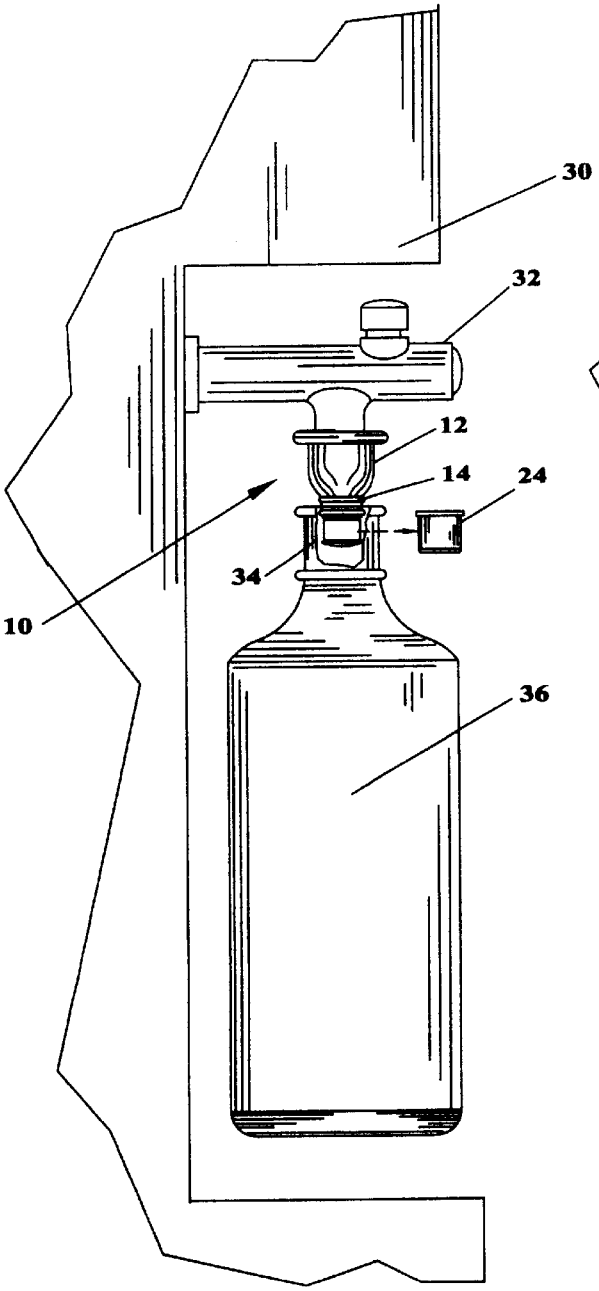
FIG. 1 illustrates a side elevation view of the device attached to a water reservoir spout according to an embodiment of the invention.
Figure 2:
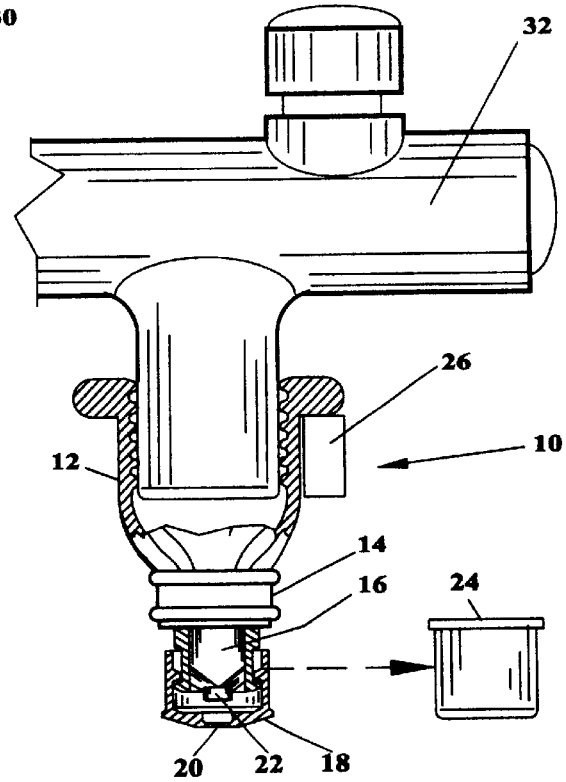
FIG. 2 illustrates a cross sectional side elevation view according to an embodiment of the invention.

Referring to FIG. 1 and 2, the bottle filling device 10 may have a flexible inlet fitting 12 and an outlet end 14. The flexible inlet fitting 12 may be formed of plastic, synthetic rubber, and the like material that may be an elastic or expansible composition material. The inlet fitting 12 may be deformed to fit over a spout 32 of a fluid reservoir 30 as for example a bottled water container.

The outlet end 14 may be attached to the inlet fitting 12 by adhesive or other treatment, or the two may be formed as one piece in a manufacturing process. The outlet end 14 may include a funnel spout 16 with a closure 18. The funnel spout 16 and closure 18 may be sized to form an opening 20 small enough to dispense fluid such as water within the diameter of the mouth 34 of a small water bottle 36. The closure 18 for funnel spout 16 may be of the push-pull friction type as is currently understood for use as a cap closure on a small water bottle wherein the opening 20 is closed by post 22 when closure 18 is moved to the closed position. It can be understood that other closure mechanisms may also be used such as a twist cap (not shown) or friction fit cap 22.

The bottle filling device 10 is illustrated in an embodiment as attached to commonly understood water dispensing fluid reservoir spout 32. In this instance a small water bottle 36, typically for hand held use, is placed under the outlet end 14 of the bottle filling device 10. With the outlet end 14 open, the spout 32 may be activated to dispense water into water bottle 36 minimizing any water spillage. When the water bottle 36 is full, the spout 32 is deactivated and the outlet end 14 may be closed by closure 19 and cap 24. The bottle filling device 10 may then be removed minimizing water spillage. The bottle filling device 10 may then have any remaining water removed. It may be stored for example by use of an attached magnet 26 to a metal panel of the fluid reservoir 30.

While the invention has been particularly shown and described with respect to the illustrated embodiments thereof, it will be understood by those skilled in the art that the foregoing and other changes in form and details may be made therein without departing from the spirit and scope of the invention.

I claim:

1. A device for aiding in the filling of a small fluid bottle container from an external liquid source comprising:

an inlet fitting that is elastic and sized to be expansible allowing a friction fit on any of a plurality of spouts of varying sizes; and an outlet end attached to said inlet end having a funnel spout having an opening therein sized for dispensing fluids within the diameter of a mouth of a small water bottle; and said outlet end has a friction fit cap.

2. A device for aiding in the filling of a small fluid bottle container from an external liquid source comprising:

an inlet fitting that is elastic and sized to be expansible allowing a friction fit on any of a plurality of spouts of varying sizes;

an outlet end attached to said inlet end having a funnel spout having an opening therein sized for dispensing fluids within the diameter of a mouth of a small water bottle;

a magnet attached to said inlet fitting.

* * * * *